US007651009B2

(12) United States Patent
Grant

(10) Patent No.: US 7,651,009 B2
(45) Date of Patent: Jan. 26, 2010

(54) LIQUID DISPENSING DEVICE

(75) Inventor: Bradford S. Grant, Bridgewater, NJ (US)

(73) Assignee: Warner Lambert Company LLC, Morris Plains, NJ (US)

( * ) Notice: Subject to any disclaimer, the term of this patent is extended or adjusted under 35 U.S.C. 154(b) by 318 days.

(21) Appl. No.: 11/143,976

(22) Filed: Jun. 2, 2005

(65) Prior Publication Data

US 2006/0032868 A1 Feb. 16, 2006

Related U.S. Application Data

(60) Provisional application No. 60/601,876, filed on Aug. 16, 2004, provisional application No. 60/601,883, filed on Aug. 16, 2004.

(51) Int. Cl.
*B67D 5/06* (2006.01)

(52) U.S. Cl. ..... 222/183; 222/402.13

(58) Field of Classification Search ..... 222/183, 222/182, 402.1, 402.21, 192, 402.11–402.15
See application file for complete search history.

(56) References Cited

U.S. PATENT DOCUMENTS 3,107,033 A * 10/1963 Sanborn ..... 222/41
3,185,350 A * 5/1965 Abplanalp et al. ..... 222/402.11
3,610,479 A * 10/1971 Venus, Jr. ..... 222/402.13
3,848,778 A * 11/1974 Meshberg ..... 222/402.11
3,865,279 A 2/1975 James
3,876,113 A * 4/1975 Trotta ..... 222/182
3,904,088 A * 9/1975 Milbourne, Sr. ..... 222/402.11
4,132,333 A * 1/1979 Debard ..... 222/402.13
4,292,966 A 10/1981 Mono et al.
4,509,515 A 4/1985 Altounyan et al.
4,678,106 A 7/1987 Newell et al.
4,819,832 A 4/1989 Lawson
4,834,083 A 5/1989 Byram et al.
4,969,578 A 11/1990 Gander et al.
5,027,982 A * 7/1991 Demarest ..... 222/182
5,105,988 A 4/1992 Knickerbocker
5,307,960 A 5/1994 Fay, Sr.
5,348,193 A 9/1994 Bruckner et al.
5,477,990 A 12/1995 Saito et al.
5,649,645 A * 7/1997 Demarest et al. ..... 222/153.07

(Continued)

FOREIGN PATENT DOCUMENTS

DE 7431161 U1 9/1974

(Continued)

OTHER PUBLICATIONS

U.S. Appl. No. 29/211,407, filed Aug. 16, 2004, Bradford Grant.

(Continued)

*Primary Examiner*—Lien T Ngo
(74) *Attorney, Agent, or Firm*—Karen G. Horowitz

(57) ABSTRACT

The present invention relates to a portable liquid dispensing device. The present invention further relates to a dispensing device equipped with a concealable nozzle which is concealed when not in use and then exposed when it is desirable to spray a liquid such as an oral care product. The liquid dispensing device may be provided with an optional key holder.

12 Claims, 11 Drawing Sheets

U.S. PATENT DOCUMENTS

| | | | | |
|---|---|---|---|---|
| 5,860,416 | A | 1/1999 | Howlett | |
| D407,644 | S | 4/1999 | de Maillard et al. | |
| 5,899,200 | A | 5/1999 | McNary | |
| 5,975,377 | A | 11/1999 | McGowens et al. | |
| 6,062,214 | A | 5/2000 | Howlett | |
| 6,164,275 | A | 12/2000 | Van Iderstine | |
| 6,261,274 | B1 | 7/2001 | Arghyris et al. | |
| 6,273,084 | B1 | 8/2001 | Frid | |
| 6,302,302 | B1 | 10/2001 | Albisetti | |
| D457,061 | S | 5/2002 | Walters | |
| 6,405,727 | B1 | 6/2002 | MacMichael et al. | |
| 6,745,760 | B2 | 6/2004 | Grychowski et al. | |
| 6,792,941 | B2 | 9/2004 | Andersson | |
| 6,971,552 | B2 * | 12/2005 | Meshberg | 222/153.13 |
| 7,047,967 | B2 | 5/2006 | Knudsen | |
| 7,077,129 | B2 | 7/2006 | Anderson et al. | |
| 2003/0136401 | A1 | 7/2003 | Jansen et al. | |
| 2004/0134488 | A1 | 7/2004 | Davies | |
| 2005/0028814 | A1 | 2/2005 | Robertson et al. | |
| 2005/0150488 | A1 | 7/2005 | Dave | |
| 2006/0071027 | A1 | 4/2006 | Davies et al. | |
| 2006/0084908 | A1 | 4/2006 | Bonney et al. | |
| 2006/0151536 | A1 | 7/2006 | Wong et al. | |

FOREIGN PATENT DOCUMENTS

| | | | |
|---|---|---|---|
| DE | 9217863 | U1 | 12/1992 |
| EP | 141725 | A1 | 10/1984 |
| EP | 670186 | A2 | 12/1990 |
| EP | 0513350 | | 11/1992 |
| EP | 601348 | A1 | 11/1993 |
| EP | 1083003 | | 3/2001 |
| FR | 2702195 | A1 | 3/1993 |
| FR | 2545382 | A1 | 5/1993 |
| WO | WO 9210408 | A1 | 6/1992 |

OTHER PUBLICATIONS

U.S. Appl. No. 29/221,406, filed Aug. 16, 2004, Bradford Grant.
U.S. Appl. No. 29/211,409, filed Aug. 16, 2004, Bradford Grant.
U.S. Appl. No. 29/211,521, filed Aug. 16, 2004, Bradford Grant.
U.S. Appl. No. 29/211,388, filed Aug. 16, 2004, Mark Zeh et al.
U.S. Appl. No. 29/211,386, filed Aug. 16, 2004, Mark Zeh et al.
U.S. Appl. No. 29/211,399, filed Aug. 16, 2004, Bradford Grant.
U.S. Appl. No. 60/601,883, filed Aug. 16, 2004, Bradford Grant.

* cited by examiner

LIQUID DISPENSING DEVICE

CROSS-REFERENCE TO RELATED PATENT APPLICATIONS

The present application claims the benefit of priority under 35 U.S.C. §119 (e) from Provisional Patent Application No. 60/601,876 titled "LIQUID DISPENSING DEVICE" filed Aug. 16, 2004, and Provisional Patent Application No. 60/601,883, titled "LIQUID DISPENSING DEVICE" filed Aug. 16, 2004, the entire disclosure of both applications are hereby incorporated by reference.

FIELD

The present invention relates to a portable liquid dispensing device. The present invention further relates to a dispensing device equipped with a concealable nozzle which is concealed when not in use and then exposed when it is desirable to spray a liquid such as an oral care product. The liquid dispensing device may be provided with an optional key holder.

BACKGROUND

A portable liquid dispensing device is a desirable product for consumers. The device can be used to dispense a variety of sprayable liquids including, but not limited to, oral care products such as breath fresheners, repellants (e.g., mace, pepper spray), personal products such as sun tan lotion deicers and the like. Such devices may be carried in a pocket, purse or the like.

A portable liquid dispensing device may be disadvantageous if liquid is prematurely or accidentally dispensed such as while the device is in a pocket or purse. One way of addressing this problem is to provide a locking mechanism for the nozzle of the device. The locking mechanism, when locked, prevents accidental contact with a pump assembly (that is used to release liquid from the nozzle). While such a system cam prevent unwanted discharge of the liquid, consumers may find the locking mechanism difficult to operate and/or forget to engage the locking mechanism while the liquid dispensing device is not in use.

It would therefore be desirable to provide a liquid dispensing device with an assembly for selectively spraying a liquid such as an oral care product such as oral care products, a breath freshener, repellant (e.g. mace, pepper spray), personal products such as sun screen, deicer and the like and which provides an easily engageable mechanism for preventing accidental spraying of the liquid. Such a device would provide an added convenience to the consumer and enable use of a liquid product such as a breath freshener in an easily accessible and convenient manner without the disadvantages or accidental discharge of the liquid.

It would be a further advance to provide a liquid dispensing device with a liquid dispensing assembly in which the dispensing assembly is protected from accidental discharge so that the user has complete control over when the liquid is dispensed from the liquid dispensing assembly.

It would also be desirable to provide the liquid dispensing device with an assembly for holding keys or other portable items. Such a device would provide an added convenience to the consumer.

BRIEF DESCRIPTION OF THE DRAWINGS

The following drawings are illustrative of exemplary embodiments of the invention and are not intended to limit the invention as encompassed and defined by the claims forming part of the application.

DETAILED DESCRIPTION

The present invention is generally directed to a portable liquid dispensing device which enables rapid and easy dispensing of a liquid (i.e. a dispense mode), yet prevents accidental discharge of the liquid when not in use (i.e. non-dispense or storage mode). The operation of the dispense and non-dispense modes can be readily facilitated by the user without the use of difficult to operate locking mechanisms. The devices may be used to dispense a variety of materials such as by spraying, squiring, misting, etc. The materials include liquids such as oral care products, breath fresheners, repellants (e.g., mace, pepper spray), personal products such as sun tan lotion, topical ointments or liquids (such as skin care products, lotions, topical analgesics, skin protectants, anti-itch formulations, etc.), deicers and the like. The devices may also be used to dispense other materials such as powders, intratracheobronchial inhalation powders, etc. Such devices may be carried in a pocket, purse or the like.

Figure 1:
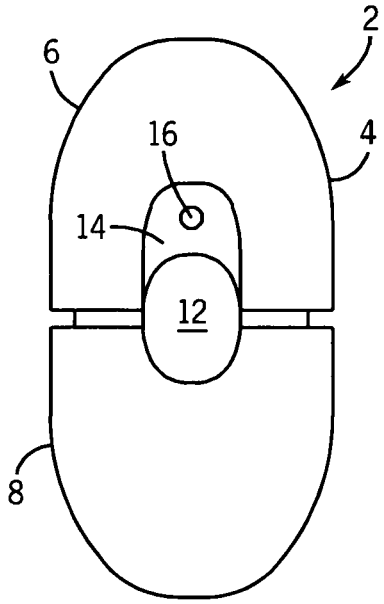
FIG. 1 is a front view of one embodiment of the liquid dispensing device employing a shield in which a liquid dispensing assembly is in a use position for delivering a sprayable liquid.
Figure 2:
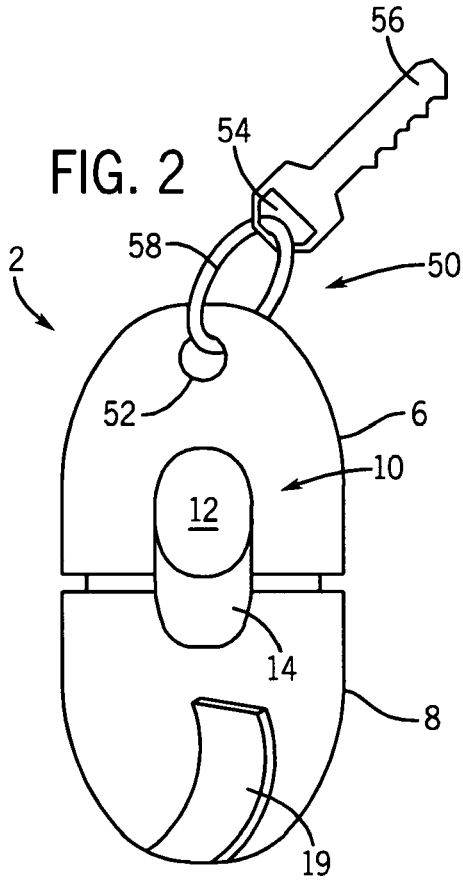
FIG. 2 is a front view of the embodiment shown in FIG. 1 with an optional key holder in which the liquid dispensing assembly is in a storage (e.g., non-actuated) position preventing the sprayable liquid from being discharged.

Referring to the drawings and particularly to FIGS. 1 and 2, there is shown a portable liquid dispensing device 2 comprised of a housing 4 having an upper housing portion 6 and a lower housing portion 8. Contained within the housing 4 is a liquid dispensing assembly 20 as described hereinafter with respect to FIG. 3.

Figure 5A:
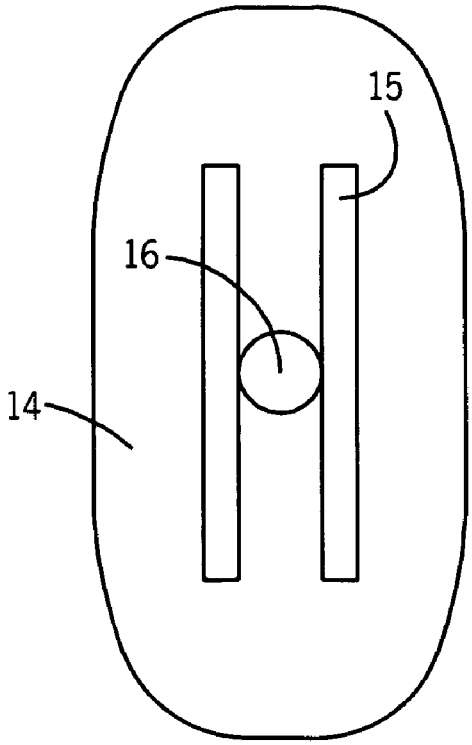
FIG. 5A is a top plan view of the track which operatively engages the shield.
Figure 5B:
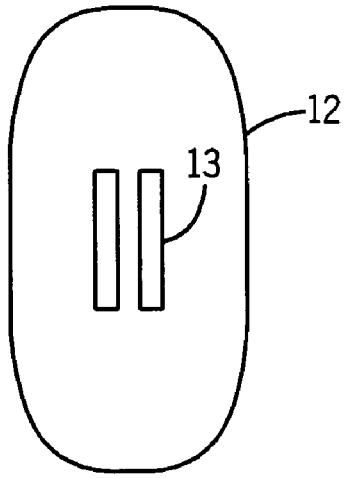
FIG. 5B is a bottom view of the shield showing runners for operatively engaging the track shown in FIG. 5A.

A liquid dispensing preventing assembly 10 comprised of a protective shield 12 (or a panel, member, plug, overlay) movable within a track 14 is shown in FIGS. 5A and 5B. The liquid dispensing preventing assembly 10 has at one end an aperture 16 which is aligned with a corresponding opening in a nozzle of the liquid dispensing assembly 20 as described.

As shown in FIG. 5B, the protective shield 12 has a pair of runners 13 (e.g., protrusions, members, extensors, etc.) movable within a corresponding pair of elongated channels 15 as shown in FIG. 5A of the track 14 from a position shown in FIG. 1 (exposing the aperture 16) to a position shown in FIG. 2 (covering the aperture 16). In the position shown in FIG. 1, when the liquid dispensing assembly is activated by the user, the liquid is released through the aperture 16 for use. When the protective shield 12 is in the position shown in FIG. 2, the liquid cannot be released because the bottom surface of the protective shield 12 covers the aperture 16 thereby preventing release of the liquid as shown in FIG. 4.

Figure 4:
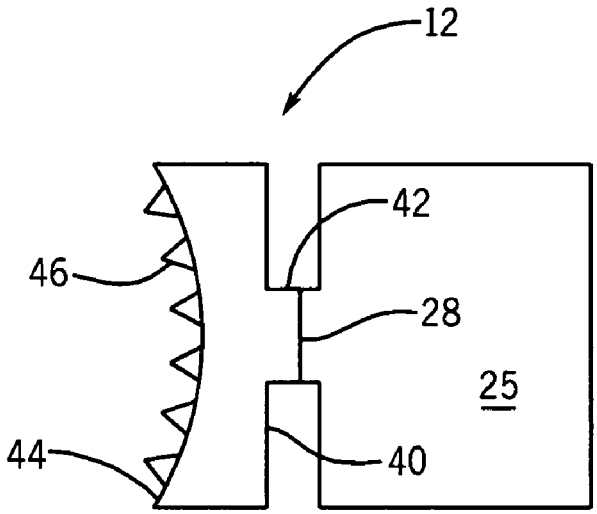
FIG. 4 is a side view of the shield in position to prevent discharge of the sprayable liquid.

Referring to FIG. 4, the protective shield 12 is shown in a position corresponding to FIG. 2. The protective shield 12 has a bottom surface 40 having a raised portion in the form of a projection 42 which is alignable with the aperture 16. The projection 42 covers the aperture 16 (not shown in FIG. 4) to thereby prevent discharge of the liquid. When the protective shield 12 is moved out of alignment with the aperture 16, the projection 42 moves out of contact with the aperture 16 to enable liquid to be dispensed when the pump mechanism is activated by the user.

Figure 3:
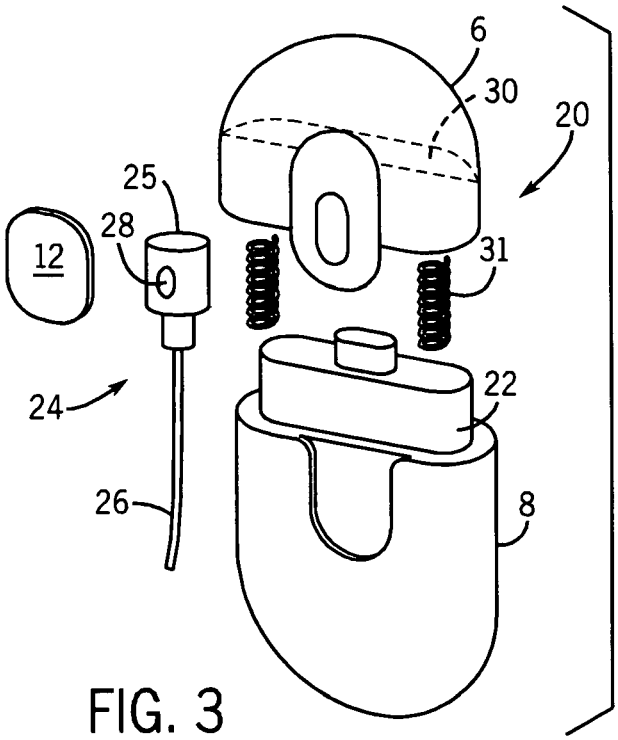
FIG. 3 is an exploded view of the embodiment of the liquid dispensing device shown in FIGS. 1 and 2.

Referring to FIG. 3 the liquid dispensing assembly 20 is comprised of a liquid storage vessel 22, a pump mechanism 24 which includes a nozzle 25, and a conduit 26 (such as to be) extending from the nozzle 25 into the liquid storage vessel 22. The nozzle 25 has an opening 28 enabling the liquid to be sprayed from the pump mechanism 24.

The liquid from the liquid storage vessel 22 moves into the nozzle 25 by application of pressure to the pump mechanism 24 through an actuator of 30. The actuator 30 is placed into contact with the nozzle 25 by the user pushing downwardly on the upper housing portion 6. The actuator is moved out of contact with the nozzle 25 by releasing the pressure enabling a spring assembly 31 or other suitable device to urge the actuator 30 back to the starting position. The pressure applied to the pump mechanism 24 causes liquid to rise through the conduit 26 and out the opening 28 and through the aperture 16 of the housing 4. Liquid dispensing assemblies for pumping liquid from a vessel of the type shown in FIG. 3 are known.

In accordance with a preferred embodiment, the front portion of the liquid dispensing assembly 20 is provided with the protective shield 12 which may be moved into a position covering the aperture 16 (and blocking opening 28 of the nozzle 25). Movement of the protective shield is facilitated by runners 13 which move glide within the corresponding channels 15. Once the protective shield 12 covers the aperture 16 accidental spraying of the liquid is prevented.

Referring again to FIGS. 1 and 2, and particularly to FIG. 1 there is provided in the upper housing portion 6 the aperture 16 which is coincident with the opening 28 of the pump mechanism 24. The protective shield 12 is movable from a first position shown in FIG. 1 which exposes the aperture 16 and thereby enables liquid to be sprayed through the opening 28 of the pump mechanism 24 and out through the aperture 16 in the upper housing portion 6. The protective shield 12 may be moved to a second position shown in FIG. 2 thus blocking the aperture 16 so that no liquid may be sprayed through the aperture 16. The user of the liquid dispensing assembly can position the protective shield 12 in the position shown in FIG. 2 to prevent spraying of the liquid. When spraying of the liquid is desired, the user moves the protective shield by applying pressure on a gripping surface 44 to the position shown in FIG. 1 providing an uninterrupted passageway for the spraying of the liquid from the liquid storage vessel 22, through the opening 28 and through the aperture 16. In a preferred embodiment shown in FIG. 4, the protective shield 12 is provided with a gripping surface 44 having ridges 46 to provide better contact between the protective shield 12 and the user's finger.

The liquid storage vessel 22 stores the liquid. The vessel 22 may be permanent within the liquid dispensing device or may be removable from the lower housing portion 8 to be refilled or replaced as desired.

In a still further embodiment, the liquid dispensing device may be provided with a clip, hook or like device such as disclosed in U.S. Pat. No. 6,527,434, incorporated herein by reference, to enable the user to attach the liquid dispensing device to a belt, belt loop, pants pocket, key chain, key ring, clip, etc. or the like. As shown in FIG. 2, the lower housing portion 8 is provided with a hook 19 which can be secured about a belt, another keychain, etc. The user may then carry the liquid dispensing device in a way that is more accessible than a pocket or purse.

The liquid dispensing device may be provided with a key holder for reversibly securing one or more keys or other portable items. Referring specifically to FIG. 2, the key holder 50 is present in the upper housing portion 6, but may easily be associated with the lower housing portion 8. It will be understood that the key holder may be associated with the lower housing portion 8 while the liquid dispensing assembly is associated with the upper housing portion 6.

The key holder 50 is removably attached to the liquid dispensing device 2 through an opening 52 in the upper housing portion 6. The key holder 50 may be a ring made out of metal or plastic or may be made of a flexible but sturdy material such as a soft plastic, cloth, a rubber-like material or the like.

The key holder 50 is able to retain keys or other portable items, typically by having the key holder 50 pass through an opening 54 in a key 56 as shown in FIG. 2. Access to the key holder 50 for the key 56 can be made through a slit 58 which can reversibly separate respective portions of the key holder 50 (i.e. a split ring) to provide access for the key 56 on the key holder 50. Because the slit 58 reversibly forms separate key holder portions, the key holder can also enable the user to attach the device to a belt, belt loop or the like.

Figure 6A:
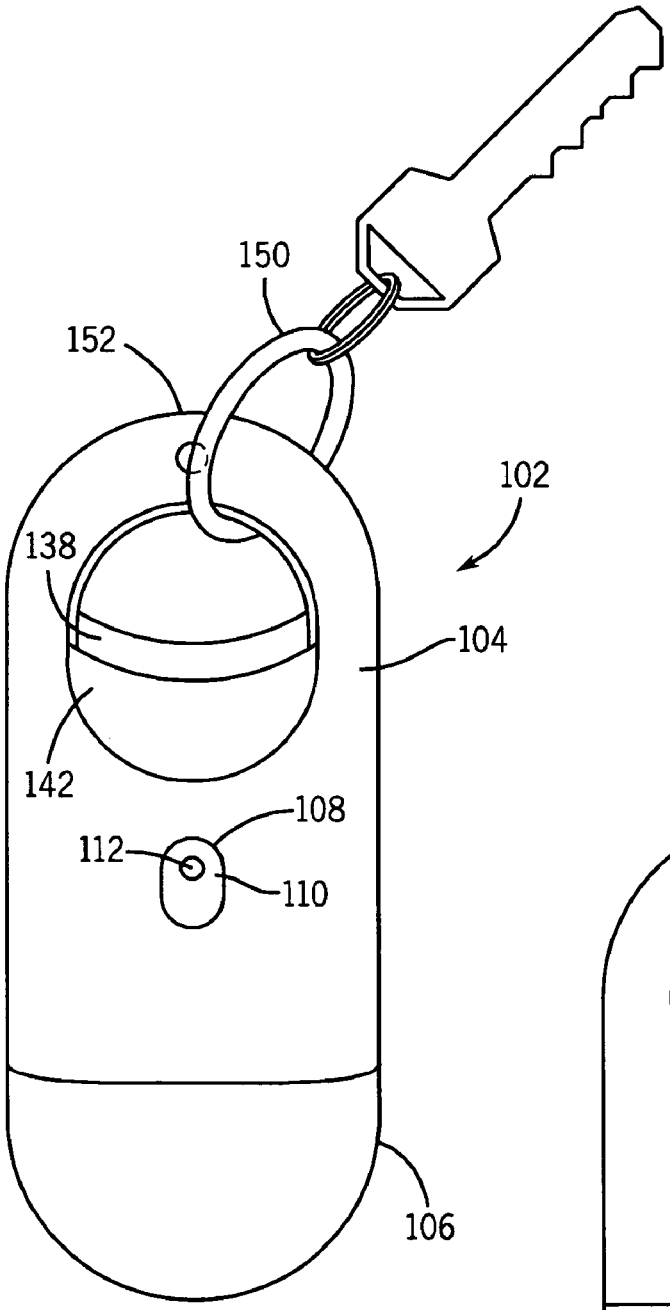
FIG. 6A is a front view of an exemplary embodiment of a liquid dispensing device with optional key holder.
Figure 6B:
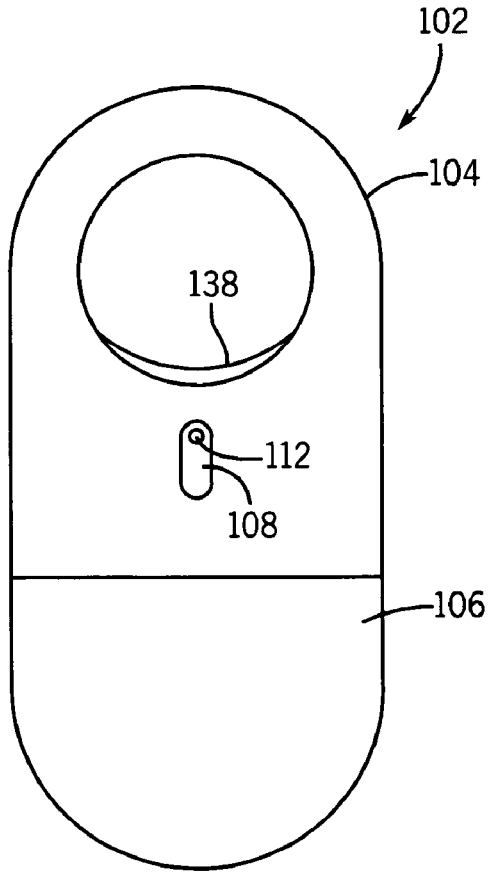
FIG. 6B is a front view of the embodiment shown in FIG. 6A in which a liquid dispensing assembly is in an actuated position with the protective shield in a position which enables the dispensing of a sprayable liquid.

According to another embodiment of the present invention, protection from accidental discharge of the liquid is provided by a protective shield or structure within the housing that blocks discharge of liquid from the nozzle until the nozzle is in a proper position. Referring to FIGS. 6A and 6B, there is shown a liquid dispensing device 102 having an upper housing portion 104 and a lower housing portion 106. On the upper housing portion 104, there is provided a region 108 which when a protective shield portion 110 of the actuator assembly 130 (See FIG. 7) is moved out of the region 108 exposes an aperture 112 through which liquid contained in the device may be dispensed as explained hereinafter.

Figure 7:
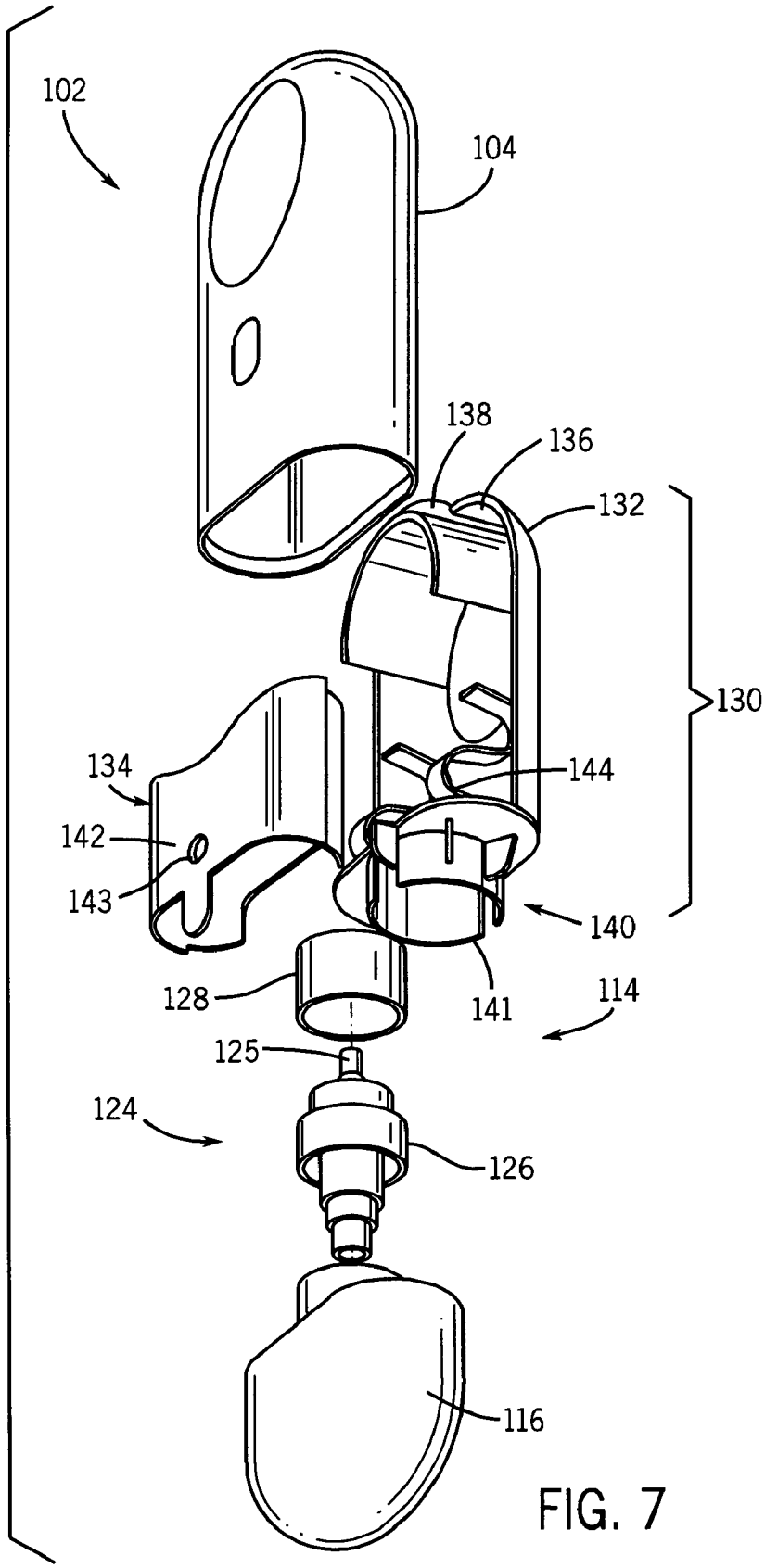
FIG. 7 is an exploded view of the embodiment shown in FIGS. 6A and 6B.

A liquid dispensing assembly is provided in the lower housing portion 106 and contains similar structural components similar to those described in connection with the embodiments shown in FIGS. 1-5. Referring to FIG. 7 the liquid dispensing assembly 114 is comprised of a liquid storage vessel 116, a pump mechanism 124 which includes a nozzle 125, and a conduit 126 extending from the nozzle 125 into a liquid storage vessel 122. The nozzle 125 has an opening 128 enabling the liquid to be sprayed from the liquid dispensing device from the liquid storage vessel 122 through the conduit 126.

The liquid from the liquid storage vessel 122 is urged into the nozzle 125 by the application of pressure to the pump mechanism 124 through an actuator assembly 130. The actuator assembly 130 is placed into contact with the nozzle 125 by the user pushing downwardly on an activating surface 138 and moved out of contact with the actuator assembly 130 by releasing the downward pressure enabling a spring assembly 131 to urge the actuator assembly 130 to its original non-dispensing mode position as described in connection with FIGS. 8A-8C.

The actuator assembly 130 not only actuates the pump mechanism 124 to deliver the liquid from the storage vessel 122 but also provides a protective shield against accidental discharge of the liquid.

As shown in FIG. 7, the actuator assembly 130 comprises a pump activating assembly 132 and a protective shield assembly 134. The pump activating assembly 132 has an upper end 136 including the user activating surface 138 which is accessible to the user as shown in FIG. 6A. A bottom end 140 remote from the surface 138 reversible contacts the pump mechanism 124 through a pump mechanism contact assembly identified by numeral 141.

The protective shield assembly 134 has a front face 142 having an aperture 144 alignable with the opening 128 in the nozzle 125 and an opening 112 in the region 108 (see FIGS. 6A and 6B) so that when the aperture 144, opening 128 and the opening 112 are in alignment, the liquid dispensing device is in a liquid dispensing mode and the liquid may be dispersed therefrom.

The protective shield assembly 134 is operatively connected to the pump actuating assembly 132 and therefore moves in concert therewith when the user presses downwardly on the actuating surface 138. Thus, the liquid dispensing assembly is actuated by applying pressure to the actuator assembly 130 and particularly to the surface 138 moving downwardly to activate the pump mechanism 124. At the same time, the protective shield assembly 134 is moved until the opening 128 and the opening 112 in the region 108 provide a clear path for the dispensing of the liquid.

Figure 8C:
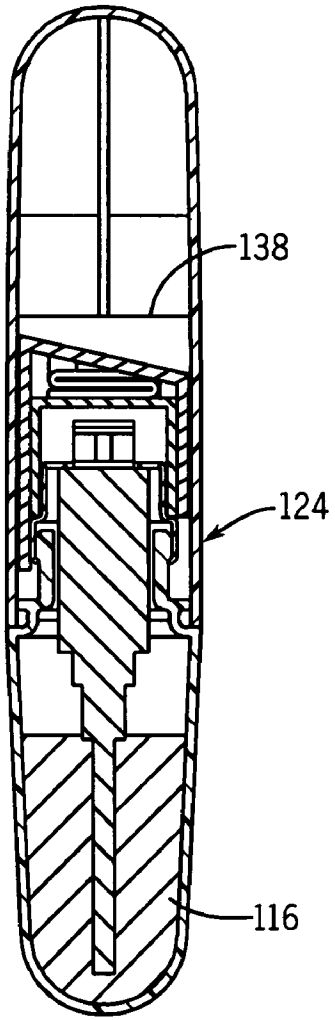
FIGS. 8A-8C are cross-sectional views of the device of FIGS. 6A-7 showing the operation of the actuator assembly for dispensing a liquid.
Figure 8B:
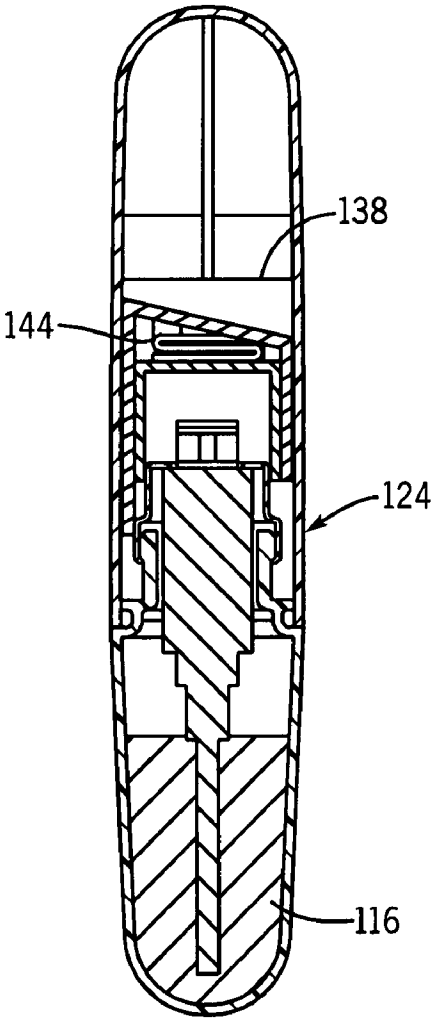
Figure 8A:
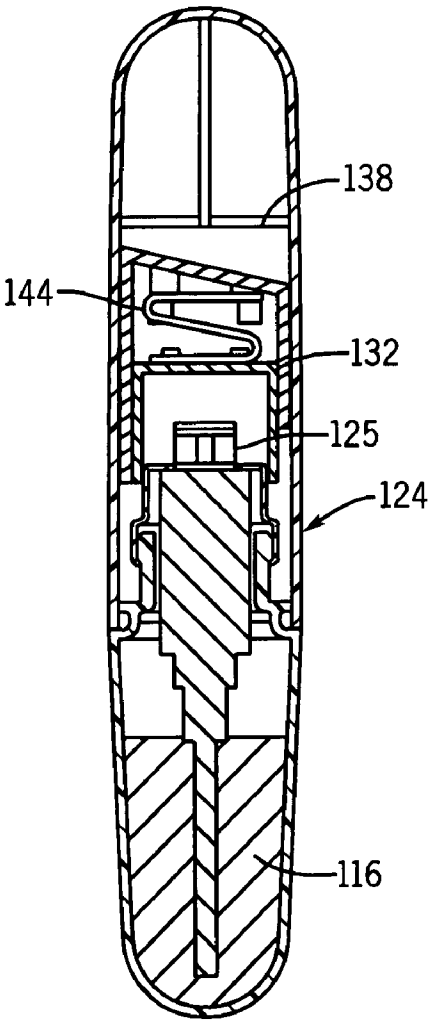

When the user releases pressure from the surface 138, both the pump actuating assembly 132 and the protective shield assembly 134 are automatically moved out of the liquid dispensing mode. This is accomplished through a spring assembly 144 as described in connection with the embodiments of FIGS. 1-5 and as shown in FIGS. 8A and 8C. In FIG. 8A, the actuator assembly 130 is shown in a non-dispense mode wherein the surface 138 is not depressed by the user. A spring assembly 144 is positioned between the pump assembly 124 and the pump actuating assembly 132 in a relaxed or non-compressed state. When the user applies pressure to the surface 138, the spring assembly 144 is compressed as shown in FIGS. 8B and 8C and subsequently the pump actuating assembly 132 contacts the pump assembly 124 to actuate the same causing liquid to flow from the storage vessel 122 through the nozzle 125 as shown in FIG. 8C. When the user releases pressure from the surface 138, the pump actuating assembly 132 moves upwardly out of contact with the pump assembly 124 due to the upward tension provided by the spring assembly 144.

As with the embodiments of FIGS. 1-5B, the liquid dispensing device of FIGS. 6A-6B can be provided with a key holder as shown specifically in FIG. 6A. The key holder 50 may be secured with the opening 150 which provides access to the surface 138 the actuator assembly 130 or in a separate opening in the upper housing portion identified by numeral 152.

Shown in FIGS. 9-16 is a dispensing device 300 according to an exemplary embodiment. Dispensing device 300 may be used to spray, squirt or otherwise dispense a material such as a liquid, powders, etc. Liquids which may be dispensed by device 300 include oral care products, breath fresheners, repellants (e.g., mace, pepper spray), deicers, personal products such as sun tan lotion, topical ointments, skin care products, gels, lotions, topical analgesics, skin protectants, anti-itch formulations, and the like. Powders, such as intratracheobronchial inhalation powders, may also be dispensed. For purposes of discussion and example, spraying liquids will be used as the example of material dispensed from device 300. However, those examples should not be construed as limiting. Device 300 may be carried in a pocket or purse and also be used as a key chain or fob of a keychain.

Figure 9:
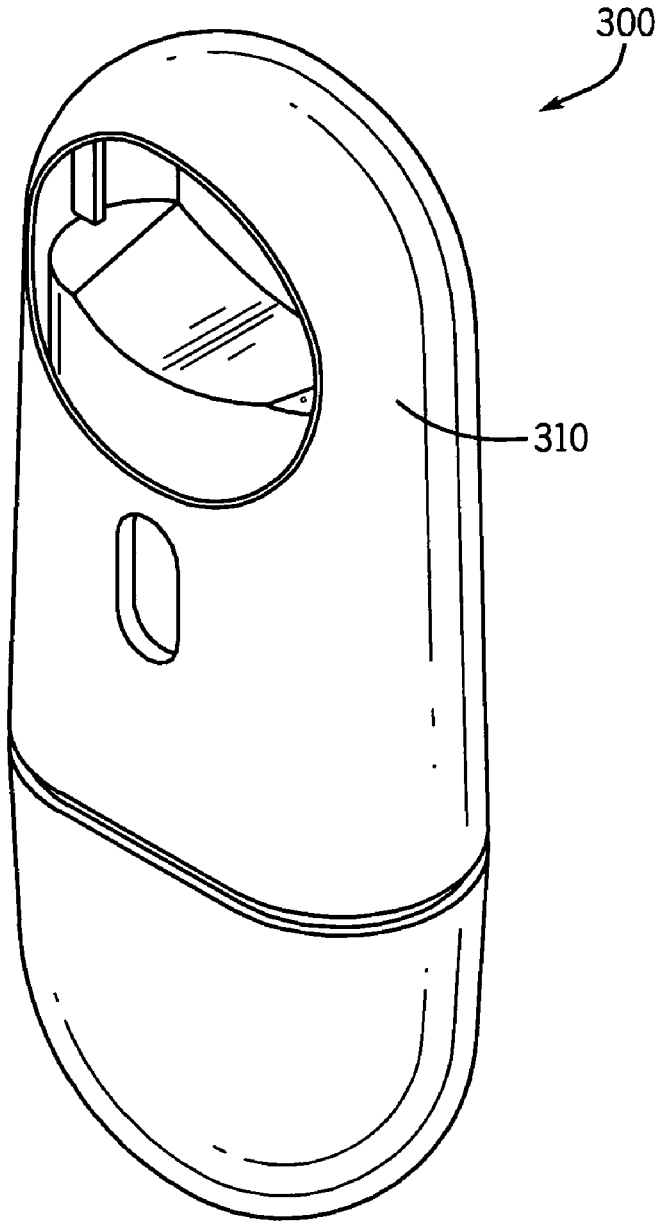
FIG. 9 is a perspective view of a dispenser device according to an exemplary embodiment.
Figure 9A:
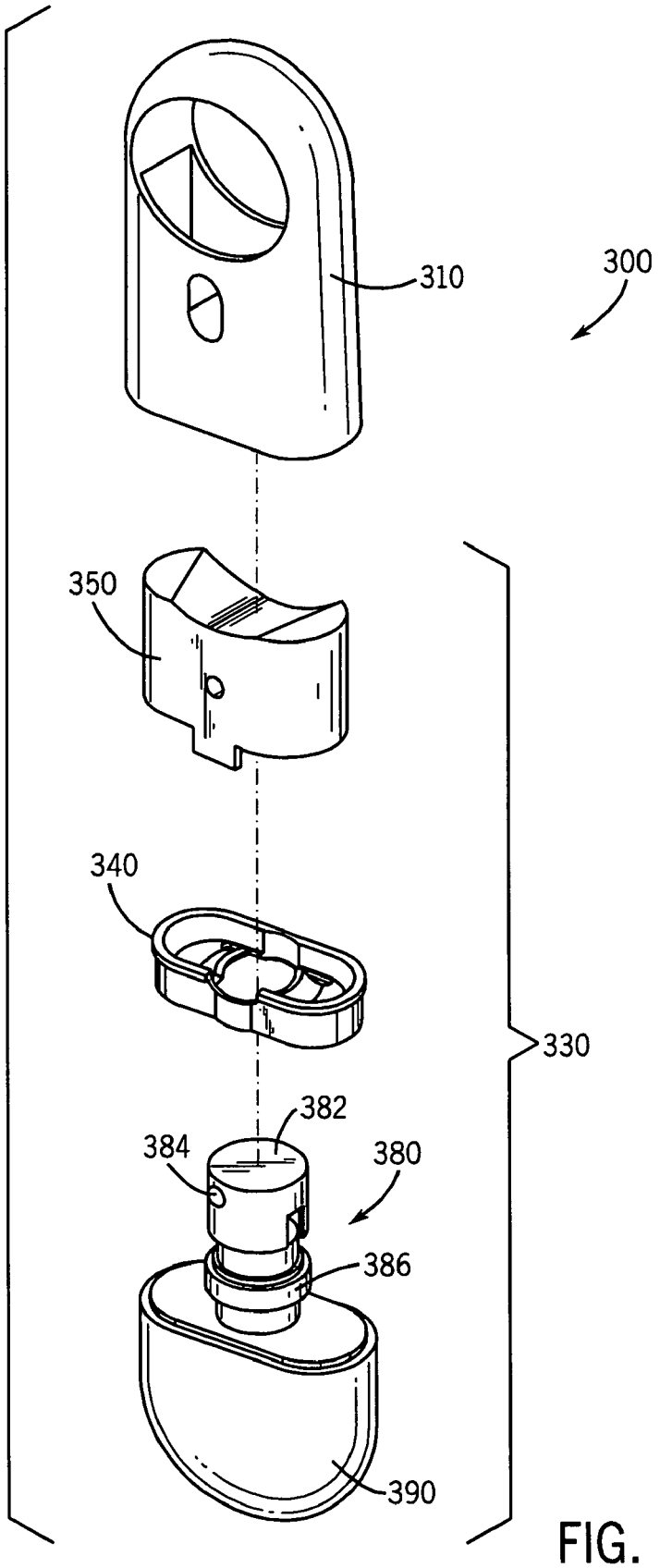
FIG. 9A is an exploded perspective view of the dispenser device shown in FIG. 9.

As shown in FIGS. 9 and 9A, device 300 comprises a cover 310 (which may also be a housing or shroud), and a dispensing assembly 330 for spraying liquid. Cover 310 forms an area in which a user may activate dispensing assembly 330 to spray liquid stored in device 300, for example, by depressing a button. Cover 310 also provides protection against accidental spraying of liquid. Cover 310 forms a protective cover or guard above the button such that material will not be dispensed unless a user places their finger within or into cover 310 and activates dispensing assembly 330. Such a configuration is advantageous to guard against accidental or unwanted spraying of liquid which may be caused by bumping device 300 while stored in a purse, pocket, etc.

Referring to FIG. 9A, device 300 comprises cover 310 and a dispensing assembly 330. Dispensing assembly 330 includes a collar 340 (which may also be a ring, retainer, etc.), a button 350 (which may also be an actuator, trigger, etc.), a pump 380 (which may also be a spray assembly, dispenser, etc.), and a container 390 (which may also be a reservoir, bottle, etc.).

Figure 10:
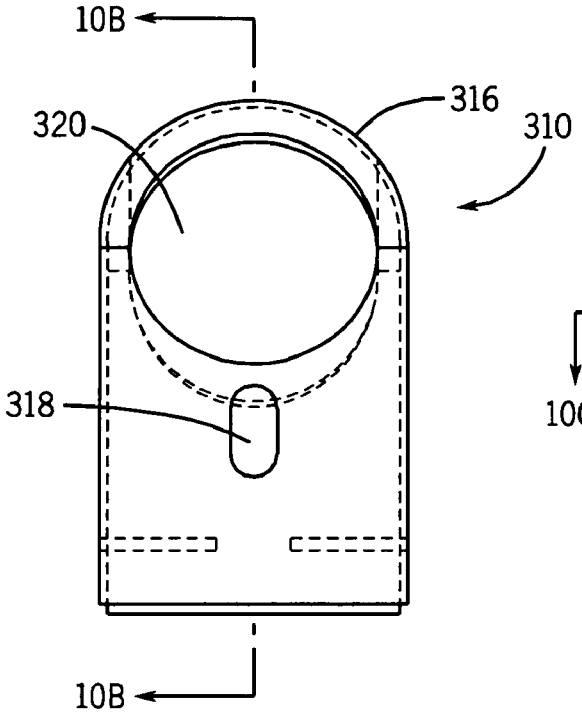
FIG. 10 is a front elevation view of a cover of the dispenser device according to an exemplary embodiment.
Figure 10A:
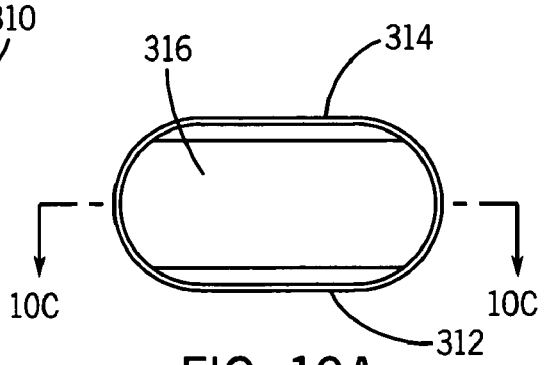
FIG. 10A is a top plan view of the cover shown in FIG. 10.
Figure 11:
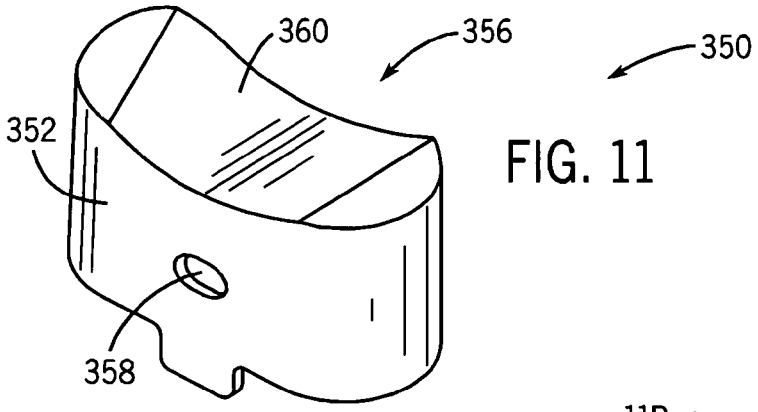
FIG. 11 is a front perspective view of a button of the dispenser device according to an exemplary embodiment.
Figure 11A:
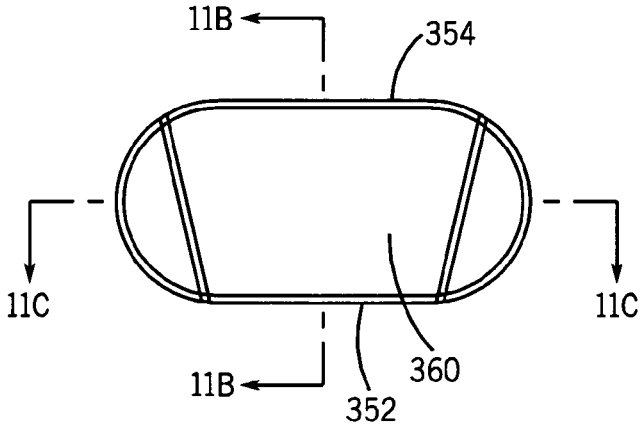
FIG. 11A is a top plan view of the button shown in FIG. 11.
Figure 11B:
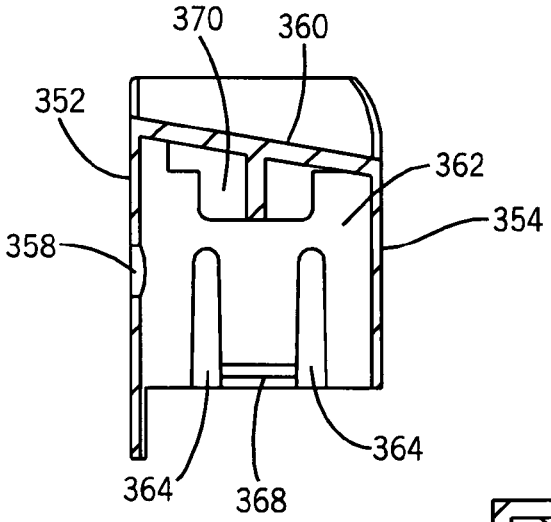
FIG. 11B is a cross-sectional view of the button taken along the line A-A shown in FIG. 11A.
Figure 11C:
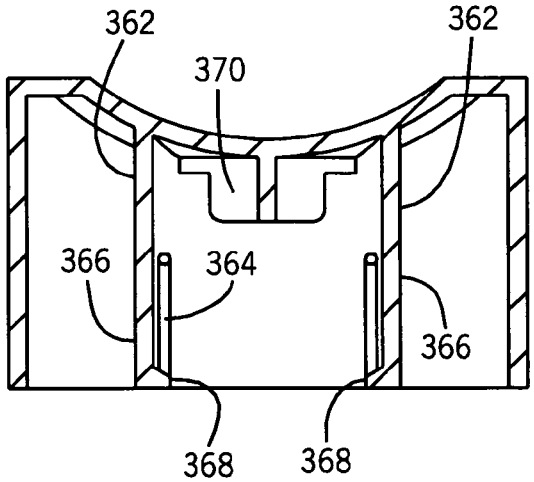
FIG. 11C is a cross-sectional view of the button taken along the line B-B shown in FIG. 11A.

As shown in FIGS. 10 to 11C, cover 310 includes a front wall 312, a rear wall 314, and an upper portion 316. Cover 310 has an open bottom to fit a portion dispensing assembly 330 into cover 310. According to a particularly preferred embodiment, cover 310 is a single body constructed of an injection molded plastic such as polypropylene.

An aperture 318 is provided in front wall 312. According to a particularly preferred embodiment, aperture 318 has an elongated oval shape. According to a particularly preferred embodiment, aperture 318 is approximately ⅛" wide and ⅜" long. According to alternative embodiments, the aperture may have a variety of shapes such as rectangular, circular, triangular, diamond, etc.

Upper portion 316 is an arched member or portion of cover 310. Portion 316 forms an opening 320 through cover 310. According to a particularly preferred embodiment, opening 320 is substantially circular in shape. According to alternative embodiments, the opening may have a variety of shapes such as rectangular, circular, triangular, diamond, etc.

As shown in FIG. 10, according to an exemplary embodiment, opening 320 is smaller in size near front wall 312, and is larger in size near back wall 314. According to a particularly preferred embodiment, opening 320 is approximately 15/16" in diameter near front wall 312, and has an elongated or oval shape near rear wall 314 of approximately 15/16" along a minor axis and 1-1/16" along a major axis. The different size configuration of opening 320 assists a user in orienting device 300 in their hand so that the device is pointing the correct direction for use, as will be explained below.

Figure 10B:
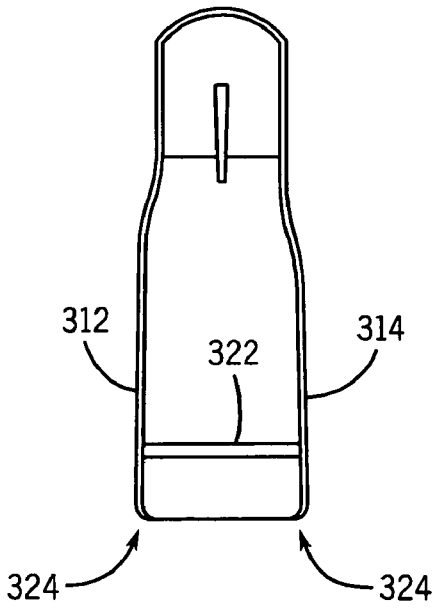
FIG. 10B is a cross-sectional view of the cover taken along the line B-B shown in FIG. 10.
Figure 10C:
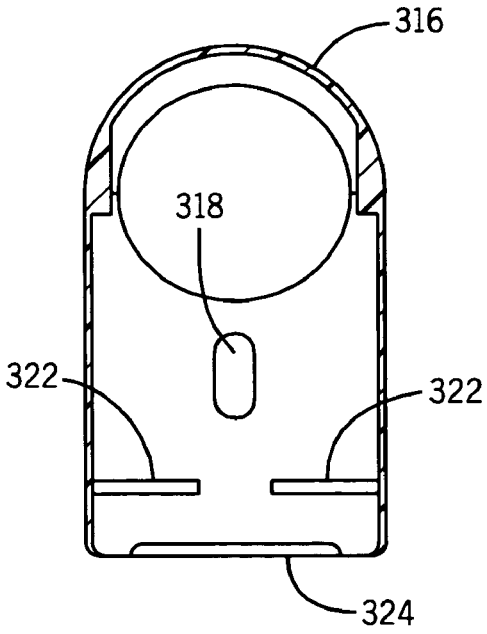
FIG. 10C is a cross-sectional view of the cover taken along the line A-A shown in FIG. 10A.

As shown in FIGS. 10B and 10C, two projections 322 are provided, each along a portion of front wall 312 and rear wall 314. Two projections 324 are also provided, one on front wall 312 and another on rear wall 314. Projection 322 and 324 assist to provide a connection (e.g., a snap fit) between cover 310 and assembly 330.

Referring now to FIGS. 11 to 11C, button 350 includes a front wall 352, a rear wall 354, and an upper portion 356. Button 350 has an open bottom to receive a portion of pump 380. An aperture 358 is provided in front wall 352. Upper portion 356 includes a tapering, sloping surface 360 as shown in FIG. 11B. According to an exemplary embodiment, surface 360 tapers from a wider width near rear wall 354, to a narrower width near front wall 352. According to a particularly preferred embodiment, surface 360 tapers from approximately 13/16" width near rear wall 354 to approximately ⅝" width near front wall 352. According to an exemplary embodiment, surface 360 slopes from a higher height near front wall 352, to a lower height near rear wall 354. According to a particularly preferred embodiment, surface 360 slopes down approximately 1/16-⅛" from front wall 352 to rear wall 354. According to a particularly preferred embodiment, button 350 is a single body constructed of an injection molded plastic such as polypropylene. According to an exemplary embodiment, button 350 is sized to slide within cover 310.

As shown in FIGS. 11B and 11C, button 350 is provided with an opening formed by a cylindrical wall 362 to receive a portion of pump 380. Wall 362 has slits or reliefs 364 provided, which form two opposed spring arms 366. Arms 366 have projections 368 provided on an end of arms 366. Arms 366 engage or coact with a head 382 of pump 380. During assembly of device 300, arms 366 move to enlarge the opening to receive head 382. Once head 382 has been received in the opening in button 350, arms 366 return to their natural position and pump 380 is partially retained by the spring force of arms 366 and projections 368 that engage head 382 along the bottom edge of head 382. As will be explained below, a nozzle 384 of pump 380 will align with aperture 358 through which liquid may be dispensed. Button 350 further comprises a projection 370 which is the point of contact or actuation with pump 380. According to a particularly preferred embodiment, one or more springs 401 (shown in FIG. 13A) is provided between button 350 and pump 380.

Figure 12:
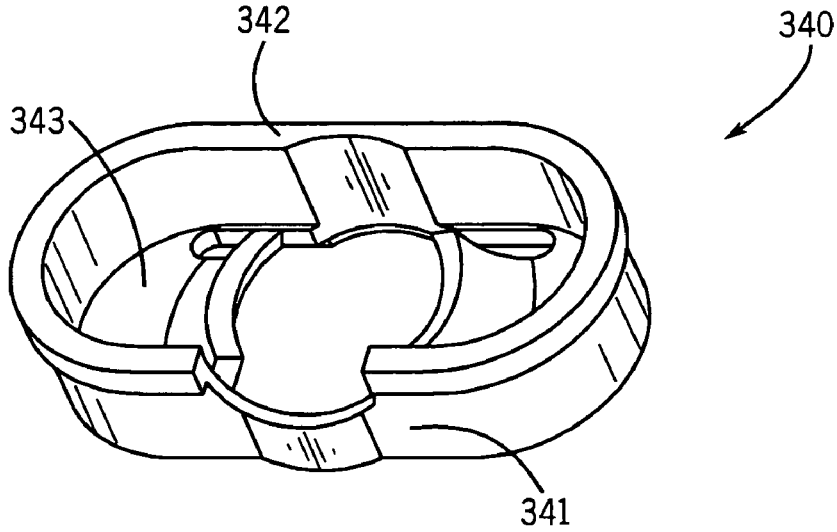
FIG. 12 is a front perspective view of a collar of the dispenser device according to an exemplary embodiment.
Figure 12A:
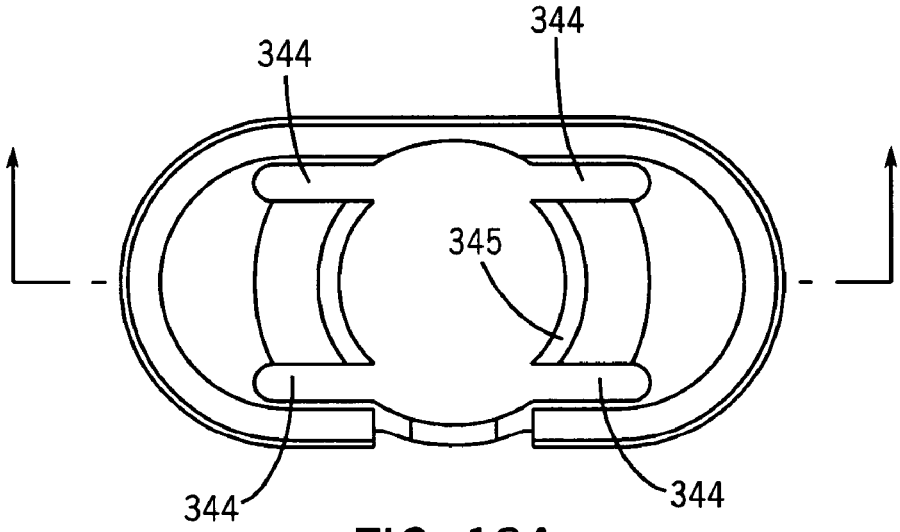
FIG. 12A is a top plan view of the collar shown in FIG. 12.
Figure 12B:
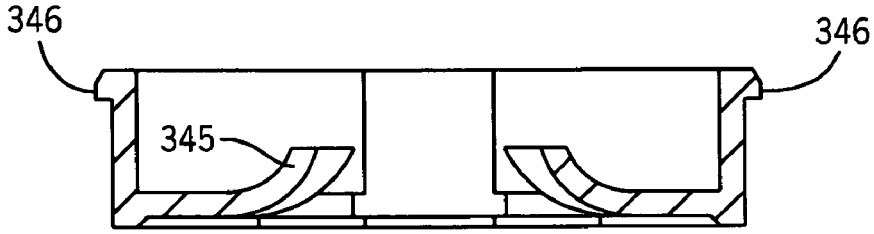
FIG. 12B is a cross-sectional view of the collar taken along the line A-A shown in FIG. 12A.

Referring now to FIGS. 12 to 12B, collar 340 includes a front wall 341, a rear wall 342 and a bottom wall 343. Wall 343 has slits or reliefs 344 provided, which form two opposed arms 345. Arms 345 engage or coact with a ferrule 386 of pump 380. During assembly or device 300, arms 345 move to enlarge the opening to receive ferrule 386. Once ferrule 386 has been received in the opening, arms 345 return to their natural position and pump 380 is held in place by arms 345 that engage ferrule 386 along the bottom edge of ferrule 386. Collar 340 further includes a projection 346 that extends around a substantial portion of the periphery of collar 340. Projection 346 engages or coacts with projection 322 provided in cover 310 to resist or limit motion of collar 340 when pump 380 is actuated.

According to a particularly preferred embodiment, collar 340 is a single body constructed of an injection molded plastic such as polypropylene. According to an exemplary embodiment, collar 340 is sized to fit within cover 310. According to a particularly preferred embodiment, collar is provided for a more secure, sturdy interface between cover 310 (which is constructed of polypropylene) and container 390 (which is constructed of polyethylene terephthalates (PTE)). According to alternative embodiments, the collar may be omitted and the cover may solely coact or attach to the container.

Referring back to FIG. 9A, a pump 380 and a container 390 are provided for spraying the desired liquid. According to a particularly preferred embodiment, pump 380 is a fragrance & crimp pump or a fine mist sprayer such as Pump No. 27SL Low Profile pump commercially available from Emsar Inc. of Strafford Conn. Alternatively, the pump may include a piston-style pump mechanism. Pump is activated by depressing head 382, which draws liquid up through a dip tube that extends into container 390. Liquid is dispensed through nozzle 384. Pump 380 is connected to container 390 by crimping or otherwise attaching ferrule 386 to a neck of container 390. Projections 324 may also engage or coact with a ring provided around the upper edge of container 390. According to an alternative embodiment, the pump may be omitted or replaced with another liquid transport mechanism such as a pressurized canister of material which enables dispensing of the material. For example, the container may be an aerosol canister or other pressurized container such that actuation of a valve enables release or dispensing of the material from the container.

Figure 13B:
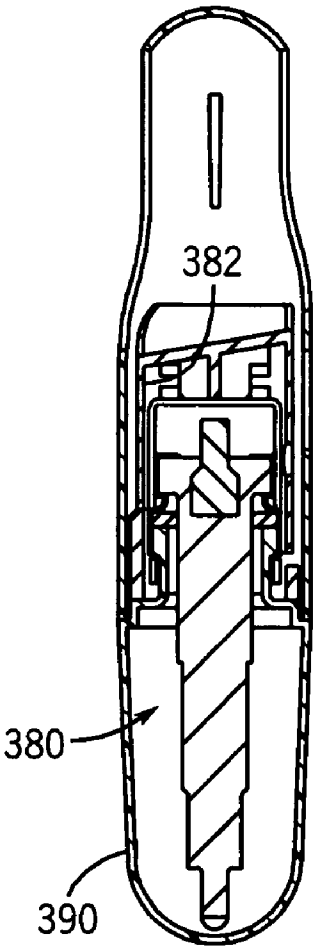
FIG. 13B is a cross-sectional view of the dispensing device taken along a center line of the device shown in FIG. 9, showing a third, dispensing position.
Figure 13A:
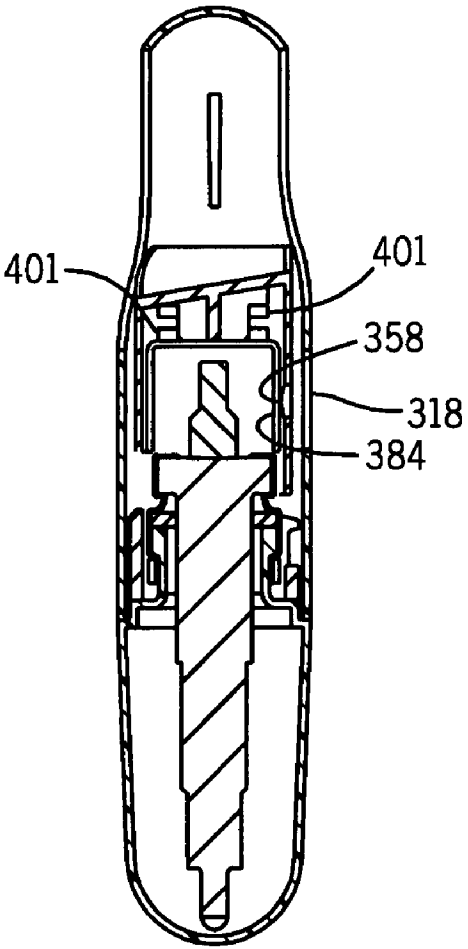
FIG. 13A is a cross-sectional view of the dispensing device taken along a center line of the device shown in FIG. 9, showing a second, pre-dispensing position.
Figure 13:
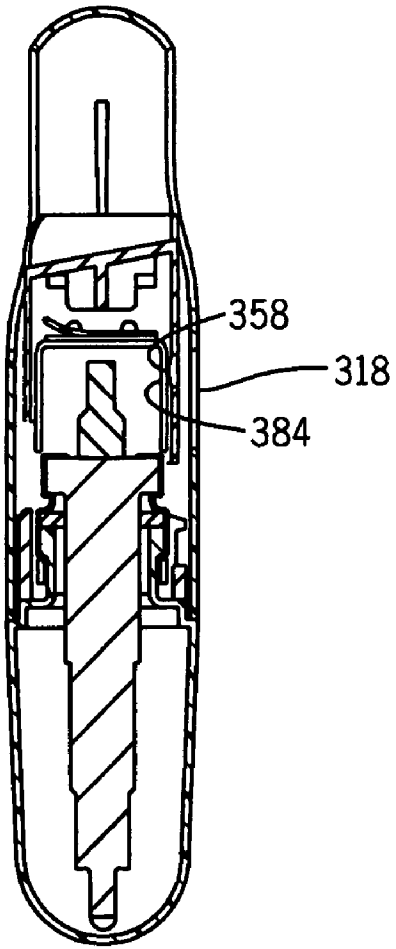
FIG. 13 is a cross-sectional view of the dispensing device taken along a center line of the device shown in FIG. 9, showing a first, storage position.

The operation of device 300 is shown in FIGS. 13 to 13B. FIG. 13 shows device 300 in a first, storage position which is not actuated by a user. In this position, aperture 358 of button 350 is out of alignment with nozzle 384 (i.e., aperture 358 is above nozzle 384). Spring 401 provides a separating force between button 350 and head 382. Furthermore, aperture 358 is not aligned with aperture 318.

FIG. 13A shows device 300 in a second, partially actuated position. A user will insert their finger into opening 320 and depress button 350. Spring 401 compresses and aperture 358 moves into alignment with nozzle 384. Furthermore, aperture 358 is aligned with the upper portion of aperture 318. At this stage, liquid has a path to move from nozzle 384, out of button 350 and out of cover 310. However, the pump is not activated so no liquid is dispensed. FIG. 13B shows device 300 in a third, fully actuated (or dispensing) position. A user has depressed button 350 to the bottom or full down-stroke position. The motion actuates pump 380. Liquid is drawn out of container 390 and sprayed through nozzle 384. The liquid spray passes through aperture 358 and aperture 318 and toward the target desired by the user (e.g., a user's mouth). Upon release of pressure by the user's finger, pump 380 returns to position shown in FIG. 13 due to a spring provided in pump (not shown) and spring 401. According to a particularly preferred embodiment, the user will depress button 350 approximately 0.1 to 0.2 inches from the first position shown in FIG. 13 to the second position shown in FIG. 13A, and the user will depress button 350 approximately 0.1 to 0.2 inches from the second position shown in FIG. 13A to the third position shown in FIG. 13B.

According to an alternative embodiment, the nozzle and button aperture may be fixed with respect to each other (i.e., always in alignment) and the user activation may cause alignment then with the cover aperture. According to another alternative embodiment, the button may be omitted and rather, the nozzle may move into and out of alignment solely with the aperture provided in the cover.

The configuration described above provides several advantageous features. First, by having spring 401 provided between button 350 and head 382, a user may partially actuate or press button 350 without causing a corresponding activation of pump 380. This is particularly advantageous to help protect against accidentally dispensing liquid. For example, providing an amount of "play" between button 350 and pump 380 will allow device 300 to accept a certain amount of bumping prior to dispensing liquid. This in combination with cover portion 316 helping guard or protect button 350, device 300 increases the resistance to accidental dispensing of liquid which was not intended by a user.

Furthermore, device 300 provides a configuration that assists a user in determining the proper orientation or direction to point device 300. For example, the tapering, sloping configuration of button 350 along with the larger rear portion of opening 320 helps to provide a user with a more comfortable, ergonomic fit to activate device 300. The user is provided with tactile feedback when they have inserted their finger into opening 320 in the wrong direction because of the sharper edges and less comfortable feel due to the button configuration.

Furthermore, device 300 provides protection or coverage of nozzle 384 against dirt and debris without requiring a removable cap or other protective structure. Nozzle 384 (as shown in FIG. 13) is generally covered or protected against dirt and debris by being out of alignment with aperture 358 and/or aperture 318. Nozzle 384 is generally covered except for a short period while being activated by a user. Upon release, the nozzle is once again covered. The configuration of device 300 provides protection against dirt and debris (such as may be in a pocket or purse), does not require additional moveable/removable parts, while still providing the user with easy use and operation.

Furthermore, device 300 advantageously provides a small, convenient, easy to use package for dispensing liquids, powders or other materials. According to a particularly preferred embodiment, device 300 is approximately 2-5 inches long, 1-3 inches wide and 0.5-1.5 inches thick. According to another particularly preferred embodiment, device is 3.1 inches long, 1.25 inches wide and 0.675 inches thick. Device 300 fits easily in a user's hand, is easily manipulated, but still provides a small, portable package.

It is also important to note that the construction and arrangement of the elements of the devices as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces or connections may be reversed or otherwise varied. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

What is claimed is:

1. A portable spray dispenser for dispensing a liquid, said dispenser comprising:

a container for storing the liquid;

a pump coupled to said container for spraying the liquid through a nozzle;

a housing provided around said nozzle, said housing comprising a first aperture;

a button provided within said housing, said button comprising a second aperture, and wherein said button is moveable from a first position to a second position to a third position; and a spring provided between said button and said nozzle;

wherein:

said spring biases said button toward the first position said nozzle and said second aperture are not aligned when said button is in the first position;

said nozzle and said first aperture and said second aperture are each aligned when said button is in the second position; and liquid is dispensed through said first aperture and said second aperture as said button moves from the second position to the third position.

2. The dispenser of claim 1, wherein said button further comprises a surface that slopes upward toward a dispensing side of said dispenser.

3. The dispenser of claim 2, wherein said surface narrows toward a dispensing side of said dispenser.

4. The dispenser of claim 1, wherein said button further comprises a surface that narrows toward a dispensing side of said dispenser.

5. A portable spray dispenser for dispensing a liquid, said dispenser comprising:

a container for storing the liquid;

a pump coupled to said container for spraying the liquid through a nozzle;

a housing provided around said nozzle, said housing comprising a first aperture; and a button provided within said housing, said button comprising a second aperture, and wherein said button is moveable from a first position to a second position to a third position;

wherein:

said nozzle and said second aperture are not aligned when said button is in the first position;

said nozzle and said first aperture and said second aperture are each aligned when said button is in the second position;

liquid is dispensed through said first aperture and said second aperture as said button moves from the second position to the third position; and said button acts as a barrier to said nozzle when said button is in the first position.

6. The dispenser of claim 1, wherein said pump is a mist spraying pump.

7. A dispensing device for dispensing a liquid desired by a user, said device comprising:

a cover having an aperture;

a dispensing assembly coupled to said cover, said dispensing assembly comprising:

a container for storing the liquid; and a liquid transport mechanism for drawing the liquid out of said container and dispensing the liquid through a nozzle, the nozzle being provided within said cover; and a button selectively movable between a first position out of operative engagement with said nozzle and a second position in operative engagement with said nozzle;

wherein:

said button and said nozzle are movable together to a third position in which said nozzle dispenses the liquid;

said nozzle is in fluid communication with said cover aperture when said button and said nozzle are in the third position; and said nozzle is out of fluid communication with said cover aperture when said button is in the first position.

8. A dispensing device for dispensing a liquid desired by a user, said device comprising:

a cover having an aperture;

a dispensing assembly coupled to said cover, said dispensing assembly comprising:

a container for storing the liquid; and a liquid transport mechanism for drawing the liquid out of said container and dispensing the liquid through a nozzle, the nozzle being provided within said cover; and a button selectively movable between a first position and a second position;

wherein:

said button moving from the first position to the second position places said nozzle in fluid communication with said cover aperture but does not activate said liquid transport mechanism; and said button moving from the second position to a third position activates said liquid transport mechanism and dispenses liquid.

9. The dispenser of claim 5, wherein said button further comprises a surface that slopes upward toward a dispensing side of said dispenser.

10. The dispenser of claim 9, wherein said surface narrows toward a dispensing side of said dispenser.

11. The dispenser of claim 5, wherein said button further comprises a surface that narrows toward a dispensing side of said dispenser.

12. The dispenser of claim 5, wherein said pump is a mist spraying pump.

* * * * *